US009995215B2

(12) United States Patent
Kwon

(10) Patent No.: US 9,995,215 B2
(45) Date of Patent: Jun. 12, 2018

(54) METHOD FOR PREVENTING PISTON OIL-UP AND ENGINE EMPLOYING THE SAME

(71) Applicant: Hyundai Motor Company, Seoul (KR)

(72) Inventor: Hyun-Jun Kwon, Yeongju-si (KR)

(73) Assignee: Hyundai Motor Company, Seoul (KR)

( * ) Notice: Subject to any disclaimer, the term of this patent is extended or adjusted under 35 U.S.C. 154(b) by 8 days.

(21) Appl. No.: 15/246,291

(22) Filed: Aug. 24, 2016

(65) Prior Publication Data

US 2017/0167371 A1 Jun. 15, 2017

(30) Foreign Application Priority Data

Dec. 10, 2015 (KR) ..... 10-2015-0175686

(51) Int. Cl.

| | |
|---|---|
| ***F02B 77/04*** | (2006.01) |
| ***F01M 13/04*** | (2006.01) |
| ***F01M 11/10*** | (2006.01) |
| ***F01M 13/00*** | (2006.01) |
| *F02B 69/04* | (2006.01) |

(52) U.S. Cl.
CPC ..... *F02B 77/04* (2013.01); *F01M 11/10* (2013.01); *F01M 13/00* (2013.01); *F01M 13/04* (2013.01); *F02B 69/04* (2013.01)

(58) Field of Classification Search
CPC ..... F02B 77/04
See application file for complete search history.

(56) References Cited

U.S. PATENT DOCUMENTS

| | | | | |
|---|---|---|---|---|
| 5,123,386 | A | 6/1992 | Wakita et al. | |
| 5,839,351 | A | 11/1998 | Nakada | |
| 6,935,220 | B2 | 8/2005 | Dunaevsky et al. | |
| 2003/0079709 | A1* | 5/2003 | Han | F02F 3/22 123/193.6 |
| 2007/0022981 | A1* | 2/2007 | Ernst | F01M 1/08 123/41.35 |
| 2008/0290013 | A1* | 11/2008 | Stausberg | B01D 29/52 210/167.04 |
| 2012/0253641 | A1* | 10/2012 | Warner | F02D 19/0605 701/104 |
| 2013/0199506 | A1* | 8/2013 | Fernandez | F01M 13/0011 123/572 |

FOREIGN PATENT DOCUMENTS

| | | | | |
|---|---|---|---|---|
| CN | 203189076 U | * | 9/2013 | |
| JP | 60-237106 A | | 11/1985 | |
| JP | 2000279851 A | * | 10/2000 | B04B 5/005 |
| KR | 10-1999-0020684 A | | 3/1999 | |

* cited by examiner

*Primary Examiner* — Jacob Amick
*Assistant Examiner* — Charles Brauch
(74) *Attorney, Agent, or Firm* — Morgan, Lewis & Bockius LLP

(57) ABSTRACT

A method for preventing a piston oil-up, may include determining an oil-up condition formation to use a controller, wherein an oil-up oil generates since an engine oil moves upward above a piston, after an engine operation state is verified; determining a suction condition of the oil-up oil to use the controller based on any of a cylinder total control suction method, a cylinder explosion sequence suction method and a cylinder identical stroke sequence suction method when the oil-up condition has been formed; and operating an oil pump to use the controller, sucking the oil-up oil to use a suction force of the oil pump and discharging the sucked oil-up oil from a cylinder block.

14 Claims, 6 Drawing Sheets

METHOD FOR PREVENTING PISTON OIL-UP AND ENGINE EMPLOYING THE SAME

CROSS-REFERENCE TO RELATED APPLICATIONS

The present application claims priority to Korean Patent Application No. 10-2015-0175686, filed on Dec. 10, 2015, which is incorporated herein by reference in its entirety.

BACKGROUND OF THE INVENTION

Field of the Invention

Exemplary embodiments of the present invention relate to a piston oil-up prevention; and, particularly, to a method for preventing a piston oil-up and an engine which is employing the method, wherein a hard carbon formation can be prevented with the aid of a quick oil suction using a pump under an oil-up formation condition of the engine.

Description of Related Art

In general, a piston oil-up may cause a hard carbon formation during a combustion in case of a high load since an engine oil moves upward through a gap between a piston ring and a cylinder.

In a commercially available CNG (Compressed Natural Gas) engine, an idle operation may cause an oil-up due to a negative pressure formation (Max. −0.7 bar) at an intake manifold and the cylinders of the engine. A long time idle operation would worsen such an oil-up due to the oil pressure which in general is higher than the pressure at an oil jet check valve, and a coasting condition would also worsen the oil-up due to a quick negative pressure formation at the intake manifold under a condition where a load is not being applied. As a result, the above-mentioned oil-up may cause many problems, for example, a carbide may be adhered to a piston and a lower surface of a head during the supply of the load since oil is inputted through a piston clearance, and particles which have separated during an opening and closing operation of an exhaust valve may cause dents between the exhaust valve and the head, thus resulting in the melting (or burning) of the valve if the above-mentioned situation worsens and worsens repeatedly.

For this reason, a commercially available CNG (Compressed Natural Gas) engine has a function to minimize any oil-up in such a way to improve an oil consumption at a low speed section/a high speed section with the aid of piston and ring pack specification improvements.

Since a trade-off relationship exists between the above-mentioned low speed section wherein it is more advantageous if an oil consumption of the engine is less and the above-mentioned high speed section wherein an appropriate oil supply is required, there may be an inevitable limit when trying to improve the oil-up through the piston and ring pack specification improvements.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a method for preventing a piston oil-up and an engine which is employing the method wherein the oil can be prevented from entering an upper portion of the piston in such a way that when an oil-up formation condition is satisfied, the oil supplied in the course of the oil-up by a forced oil suction by a pumping operation will be supplied to the outside of a cylinder block, and the oil-up can be prevented by a pump control carried out in cooperation with an engine oil pressure and a manifold negative pressure, whereupon the oil-up prevention can be efficiently carried out during the idle operation and the coasting condition.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a method for preventing oil-up may include, but is not limited to, (a) determining an oil-up condition formation in such a way to use a controller, wherein an oil-up oil generates since an engine oil moves upward above a piston, after an engine operation state is verified; (b) determining a suction condition of the oil-up oil in such a way to use the controller based on any of a cylinder total control suction method, a cylinder explosion sequence suction method and a cylinder identical stroke sequence suction method when the oil-up condition has formed; and (c) operating an oil pump in such a way to use the controller, sucking the oil-up oil in such a way to use a suction force of the oil pump and discharging the sucked oil-up oil from a cylinder block.

According to an exemplary embodiment of the present invention, the engine operation state is checked based on the detection values of an engine RPM (Revolution Per Minute) and an oil pressure.

According to an exemplary embodiment of the present invention, the oil-up condition formation is determined based on an engine idle condition and a coasting condition, and the determination on the coasting condition is carried after the engine idle condition is judged. The engine idle condition is an oil pressure, and the coasting condition is an intake manifold negative pressure, and the oil pressure is compared to a check valve opening pressure of an engine oil flow passage of the engine, and if the oil pressure is equal to or larger than the check valve opening pressure, it is determined as an occasion where an oil-up condition has formed. The coasting condition is an intake manifold negative pressure, and the intake manifold negative pressure is compared to 100 Kpa, and if the intake manifold negative pressure is smaller than 100 Kpa, it is determined as an occasion where an oil-up condition has formed.

According to an exemplary embodiment of the present invention, in the cylinder total control suction method, the oil-up oil is simultaneously sucked by a plurality of cylinders of the engine, and in the cylinder explosion sequence suction method, the oil-up oil is sucked in an explosion sequence of a plurality of the cylinders of the engine, and in the cylinder identical stroke sequence suction method, the oil-up oil is sucked based on the motions at the same top and bottom dead points of a plurality of the cylinders of the engine.

According to an exemplary embodiment of the present invention, the controller controls a pump ECU (Electronic Control Unit), and the pump ECU controls the oil pump, and the controller is an engine ECU (Electronic Control Unit).

In accordance with an embodiment of the present invention, an engine may include, but is not limited to a piston which is provided at each of a plurality of cylinders of a cylinder block, wherein an oil suction hole is formed at a piston ring; an oil-up oil suction system which includes a plurality of oil suction lines connected to the piston and extending from the cylinder block, an oil pump which is driven if an oil pressure of the engine rises or an intake manifold negative pressure decreases, thus generating a suction force at the oil suction lines, and a pump ECU (Electronic Control Unit) associated with the engine ECU (Electronic Control Unit) to control the oil pump; and an oil filter unit which is connected to an outlet of the oil suction line and is configured to supply the mist oil containing a blow-by gas to a turbo charger while supplying the purified oil of the oil discharged from the cylinder block to the oil fan.

According to an embodiment of the present invention, the engine is a heavy commercial CNG engine. According to various aspects of the present invention, since oil which may move upward above the piston due to the oil-up is forcibly sucked by the pump and is discharged to the outside of the cylinder block, whereupon any input of the oil into an upper portion of the piston can be prevented during the idle operation and the coasting during which the oil-up can easily occur.

Moreover, in the present invention, since any input of the oil into an upper portion of the piston due to the oil-up can be prevented, a hard carbon will not be adhered to the piston and the lower surface of the head during combustion, and the service life of the exhaust valve can be extended thanks to the prevention of the carbon accumulation.

Furthermore, since the piston oil-up of the present invention can be prevented on a software basis by a pump control, an oil-up problem can be greatly improved as compared to a hardware-associated oil-up prevention method, for example, based on the piston and ring pack specification improvements.

Moreover, the reliability of the engine according to the present invention can be greatly enhanced since the service life of the exhaust valve can be extended with the aid of the piston oil-up prevention method of the present invention.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1A:
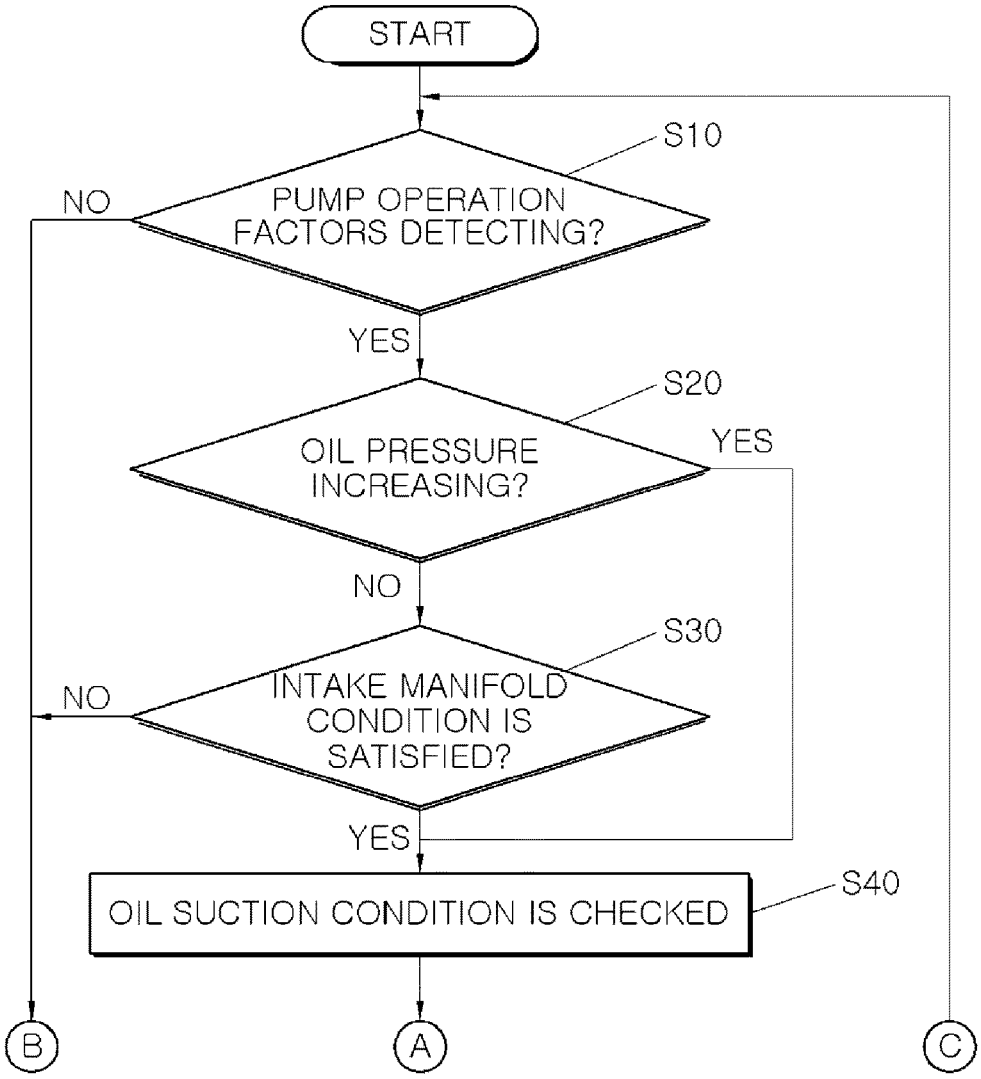
FIG. 1A and FIG. 1B are a flow chart for describing a piston oil-up prevention method according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The terms and words used in the specification and claims should not be construed as their ordinary or dictionary sense. On the basis of the principle that the inventor can define the appropriate concept of a term in order to describe his/her own invention in the best way, it should be construed as meaning and concepts for complying with the technical idea of the present invention. Accordingly, the embodiments described in the present specification and the construction shown in the drawings are nothing but one exemplary embodiment of the present invention, and it does not cover all the technical ideas of the invention. Thus, it should be understood that various changes and modifications may be made at the time of filing the present application. In addition, detailed descriptions of functions and constructions well known in the art may be omitted to avoid unnecessarily obscuring the gist of the present invention. Exemplary embodiments of the present invention will be described below in more detail with reference to the accompanying drawings.

Figure 1B:
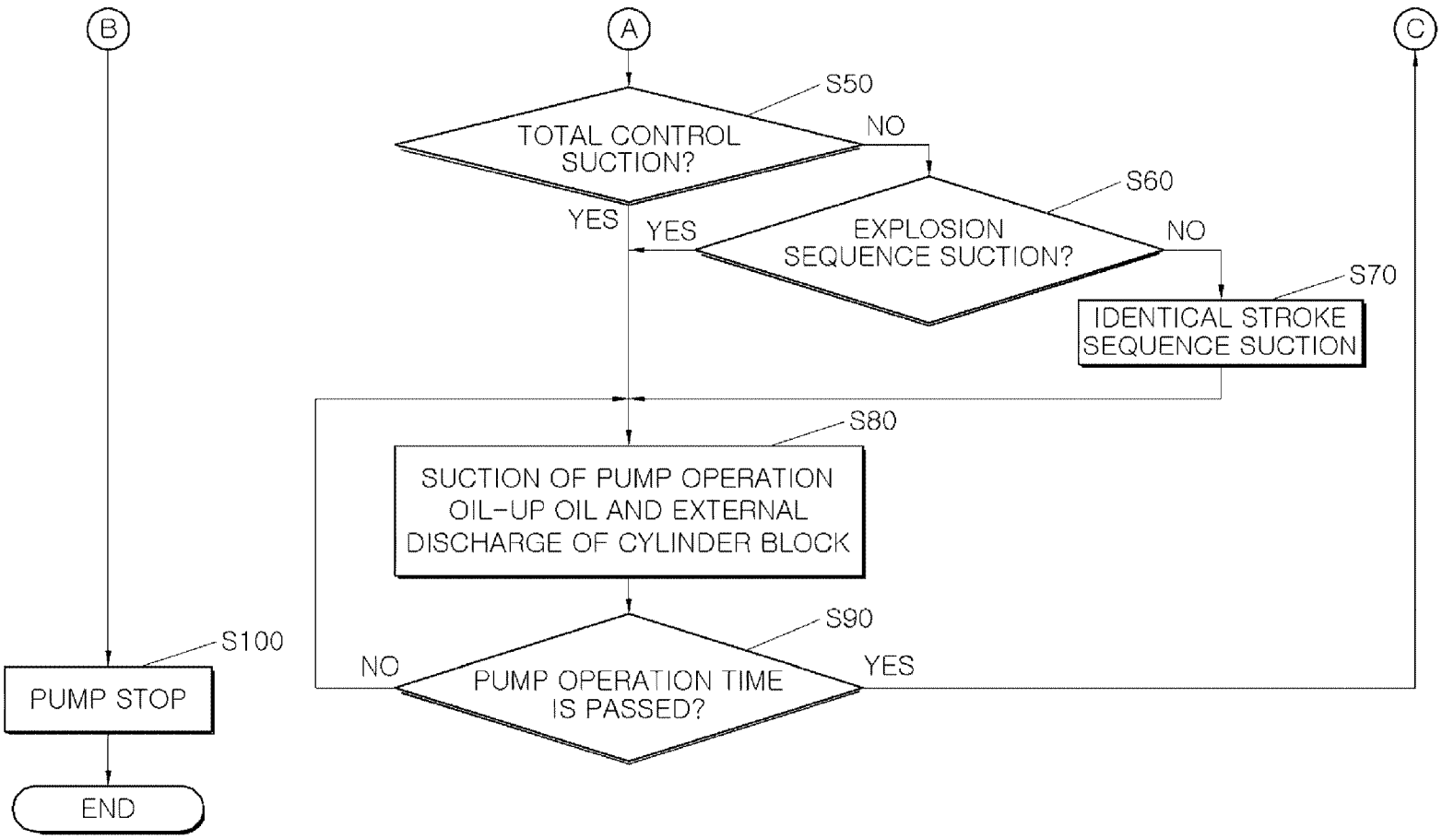

FIGS. 1A and 1B are a flow chart for describing a piston oil-up prevention method according to an exemplary embodiment of the present invention. The piston oil-up prevention method may include verifying, through two stages, an oil-up condition formation (S10 to S30), and discharging, in various ways, the oil which moves upward above the piston based on the oil-up condition (S40 to S80).

Figure 2:
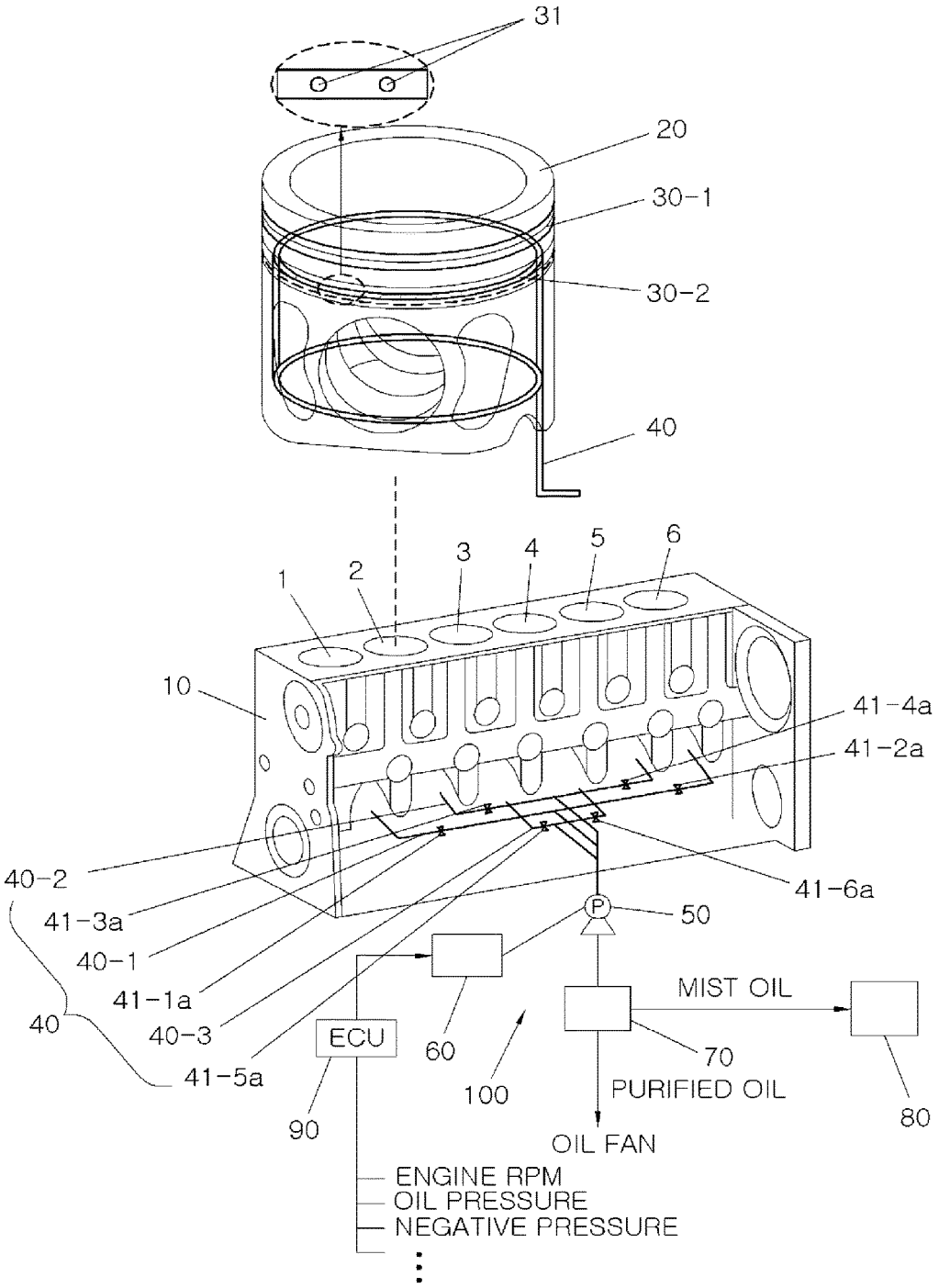
FIG. 2 is a view illustrating a configuration of a commercially available CNG engine to which an oil-up oil suction device is employed according to an exemplary embodiment of the present invention.
Figure 3:
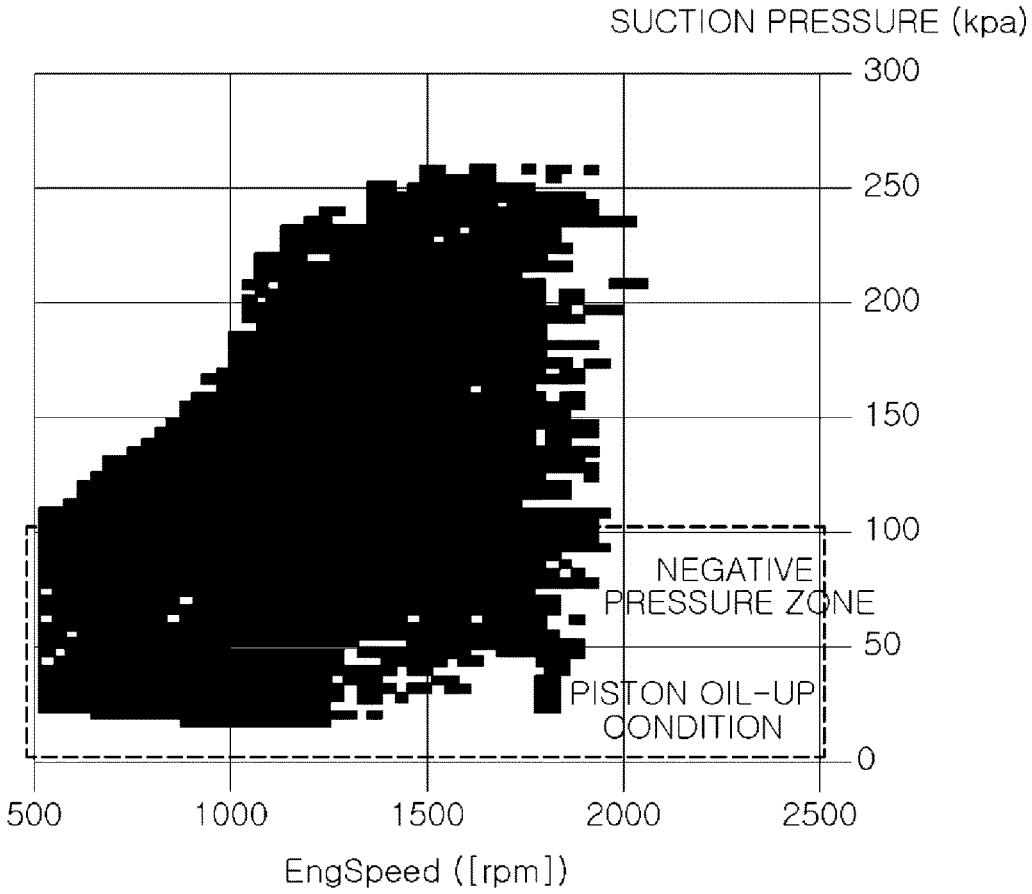
FIG. 3 is a view illustrating an engine RPM (Revolution Per Minute)-negative pressure curve of an engine according to an exemplary embodiment of the present invention.

FIG. 2 is a view illustrating a cylinder block of an engine to which an oil-up oil suction device is employed according to an exemplary embodiment of the present invention. As illustrated therein, the oil-up oil suction system 100 may include, but is not limited to, an oil suction line 40 which is associated with first, second, third, fourth, fifth and sixth cylinders 1, 2, 3, 4, 5 and 6 of a cylinder block 10, an oil pump 50, a pump ECU (Electronic Control Unit) 60, an oil filter unit 70, a turbo charger 80, and an engine ECU (Electronic Control Unit) 90.

More specifically, the oil suction line 40 may be divided into first, second and third flexible hoses 40-1, 40-2 and 40-3, and the first, second and third flexible hoses 40-1, 40-2 and 40-3 are extended from the cylinder block 10 and are combined into one hose. For example, the first flexible hose 40-1 may be associated with the piston 20 which is provided at the first cylinder 1 and the sixth cylinder 6, and the second flexible hose 40-2 may be associated with the piston 20 which is provided at the second cylinder 2 and the fifth cylinder 5, and the third flexible hose 40-3 may be associated with the piston 20 which is provided at the third cylinder 3 and the fourth cylinder 4, whereupon the oil which moves upward above the piston 20 of each cylinder can be discharged to the outside of the cylinder block 10. Moreover, each of the first, second and third flexible hoses 40-1, 40-2 and 40-3 is connected to the piston 20 via a nipple of the cylinder block 10. Furthermore, first and second control valves 41-1*a* and 41-2*a* are installed at the first flexible hose 40-1, and third and fourth control valves 41-3*a* and 41-4*a* are installed at the second flexible hose 40-2, and fifth and sixth control valves 41-5*a* and 41-6*a* are installed at the third flexible hose 40-3, and each of the first, second, third, fourth, fifth and sixth control valves 41-1*a*, 41-2*a*, 41-3*a*, 41-4*a*, 41-5*a* and 41-6*a* can be opened or closed by the pump ECU 60 or the engine ECU 90. Moreover, the first, second, third, fourth, fifth and sixth control valves 41-1*a*, 41-2*a*, 41-3*a*, 41-4*a*, 41-5*a* and 41-6*a* may be formed of an on/off type valve or a solenoid type valve.

In particular, the oil suction line 40 may include the first flexible hose 40-1 which is associated with the piston 20 installed at the first cylinder 1 and the fourth cylinder 4, and the second flexible hose 40-2 which is associated with the piston 20 installed at the second cylinder 2 and the third cylinder 3. The cylinder block 10, therefore, has been above described assuming that it is a cylinder block for a 6-cylinder engine wherein it is divided into the first, second, third, fourth, fifth and sixth cylinders 1, 2 3, 4, 5 and 6, but the cylinder block 10 may be a cylinder block for an engine wherein the number of cylinders is over six or the number thereof is smaller than six cylinders depending on the specification of the engine. Moreover, the piston 20 may equip with at least two first and second piston rings 30-1 and 30-2, and the second piston ring 30-2 may have at least two oil suction holes 31 which are associated with the oil suction line 40.

More specifically, the oil pump 50 is provided at the oil suction line 40 wherein the first, second and third flexible hoses 40-1, 40-2 and 40-3 are combined into one hose and are connected to the oil filter unit 70, by which the oil which moves upward above the piston 20 via the first, second and third flexible hoses 40-1, 40-2 and 40-3 can be sucked to the outside of the cylinder block 10. For this operation, the oil pump 50 may be an electronic motor pump, but alternatively may be one of various kinds of pumps which are able to provide suction effects, if necessary.

More specifically, the pump ECU 60 may output a control signal to drive the oil pump 50. For example, the control signal may be an on/off signal, but it is preferably a PWM (Pulse Width Modulation) duty signal. The pump ECU 60 may be an exclusively employed controller to drive the oil pump 50, but the engine ECU 90 may be configured to carry out the same function instead of employing the pump ECU 60.

More specifically, the oil filter unit 70 is connected to an outlet of the oil pump 50 via a hose and is able to return back to an oil fan the oil which has been outputted from the cylinder block 10 via the oil suction line 40 and has been purified and is able to supply mist oil which is containing blow-by gas, to a turbo charger 80. The oil filter unit 70 is a CCV filter (Crank Case Ventilation Filter).

More specifically, the turbo charger 80 is connected to an outlet of the oil filter unit 70 and is able to input the mist oil containing the blow-by gas outputted from the oil filter unit 70, into a compressor, and the mist oil is combusted in the engine. For example, the turbo charger 80 is the same as a turbo charger which is able to supercharge the intake by using exhaust gas which is outputted from the engine.

More specifically, the engine ECU 90 is able to read, in the form of an input data, an engine RPM (Revolution Per Minute), an oil pressure, a check valve opening pressure, and an intake manifold negative pressure, and judge a level difference between the oil pressure and the check valve opening pressure by using the input value, judge a level difference between the intake manifold negative pressure and the absolute pressure and control the pump ECU 60 to stop or drive the oil pump 50 based on a result of the judgments. In particular, the engine ECU 90 may have the function of the pump ECU 60 to control the operations of the oil pump 50.

The exemplary embodiment of the piston oil-up prevention method in FIG. 1 will be described in detail with reference to FIG. 2 to FIG. 5. Except for the control of the oil pump 50 by the pump ECU 60, the piston oil-up prevention which is carried out using the engine ECU 90 will be described. Here, the engine ECU 90 is not limited to an engine control function. Namely, it is also able to carry out the functions of the typical controllers.

In a step S10, the engine operation state is verified by the engine ECU 90. For this verification, the engine ECU 90 will determine the states of the engine and the oil pressure by reading the values detected by the engine RPM sensor and the oil pressure sensor. In this step, the engine ECU 90 may go to two different steps. In the case of one step, if the detections of the engine RPM and the oil pressure are not determined, it has nothing to do with the oil-up condition, whereupon the routine will go to a step S100. In the case of other step, the engine ECU 90 will control the pump ECU 60 for the stop state of the oil pump 50 to be maintained, and if the detections thereof are determined, the routine will go to a step S20, and the engine ECU 90 will determine that a first step oil-up condition exists for the driving of the oil pump 50.

In the step S20, the level of the detected oil pressure is verified by the engine ECU 90. For this verification, the engine ECU 90 will compare the oil pressure and the check valve opening pressure based on a relational formula of "the oil pressure>the check valve opening pressure". Here, ">" means a sign of inequality, more specifically, "the oil pressure>the check valve opening pressure" means that the oil pressure is larger than the check valve opening pressure. The check valve opening pressure is corresponding to a pressure at a check valve installed at the engine oil flow passage in the cylinder block so as to flow the engine oil from the oil fan to the engine oil flow passage. For this reason, if the condition of "the oil pressure>the check valve opening pressure" is satisfied, which means the oil-up formation, wherein the oil moves upward above the piston as the check valve is opened, the engine ECU 90 will go to an oil suction condition check step which corresponds to a step S40. It is possible to determine a condition wherein the oil temperature may decrease during the long time idle operation in such a way to use the oil pressure, and the oil pressure relatively increases and would be higher than the check valve opening pressure. More specifically, a hard carbon formation due to an oil combustion under the long time idle operation condition wherein the piston oil-up would be likely to be formed, can be prevented.

In a step S30, the engine ECU 90 will verify the level of the intake manifold negative pressure which is detected under a condition wherein the oil pressure is not larger than the check valve opening pressure. For this verification, the engine ECU 90 will compare the intake manifold negative pressure based on a relational formula of "the intake manifold negative pressure<100 Kpa". Here, "<" means a sign of inequality, more specifically, "the intake manifold negative pressure<100 Kpa" means that the intake manifold negative pressure is smaller than 100 kpa. In this way, the reason why the engine ECU 90 compares the intake manifold negative pressure to the absolute pressure of 100 Kpa may be expressed in the form of an engine RPM—intake pressure curve in FIG. 3. As illustrated therein, the negative pressure generation zone of a heavy commercial vehicle which in general is used in the field has a pressure smaller than 100 Kpa. The zone wherein the pressure is smaller than 70 Kpa may mean a long time idle operation condition or a coasting condition wherein the formation of the piston oil-up is inevitable. The engine ECU 90 therefore will go to an oil suction condition check step which corresponds to the step S40 if the condition of "the intake manifold negative pressure<100 kpa" is satisfied, which means the oil-up formation wherein the oil moves upward above the piston due to the negative pressure. In this way, it is possible to determine an environment which is advantageous for the oil to move upward above the piton due to the negative pressure during the coasting in such a way to use the intake manifold negative pressure. A hard carbon formation due to an oil combustion under the coasting condition wherein the piston oil-up is likely to be formed, therefore can be prevented. If the condition of "the intake manifold negative pressure<100 kap" is not satisfied, which has nothing to do with the oil-up condition, the engine ECU 90 will go to the step S100 and control the pump ECU 60 for the stop state of the oil pump 50 to be maintained.

The step S40 is a step wherein the oil suction condition is checked by the engine ECU 90. As a result, the engine ECU 90 will classify the suction method into a cylinder total control suction method in a step S50, a cylinder explosion sequence suction method in a step S60 or a cylinder identical stroke sequence suction method in a step S70 and will control the pump ECU 60, by which the oil which may move upward above the piston can be discharged to the outside of the cylinder block 10 with the aid of the oil suction based on the driving of the oil pump 50 as in a step S80.

Figure 4:
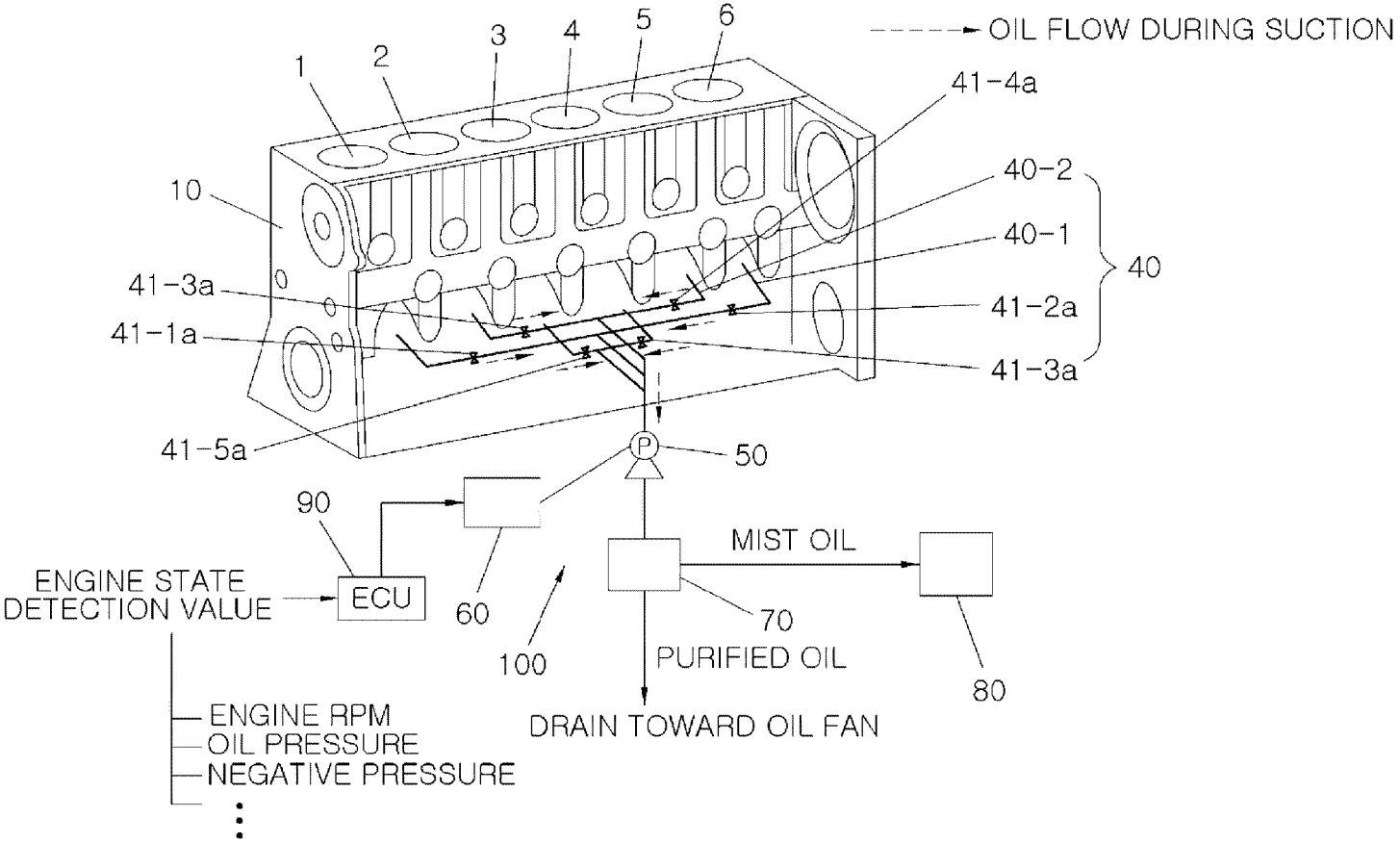
FIG. 4 is a view illustrating a state where an oil-up oil suction system is operating in the engine according to an exemplary embodiment of the present invention.

Referring to FIG. 4, the oil-up oil which has discharged via the cylinder block 10 by any of the cylinder total control suction method, the cylinder explosion sequence suction method and the cylinder identical stroke sequence suction method can enter the oil filter unit 70 via the oil suction line 40, and the oil filter unit 70 will return back the oil which has been purified through the internal procedures, to the oil fan, and at the same time will supply the mist oil which is containing blow-by gas to the turbo charger 80. Since the oil input into the upper surface of the piston due to the oil-up can be prevented, a hard carbon will not accumulate at the piston and the lower surface of the head during the combustion.

The cylinder total control suction method is a method wherein the first, second, third, fourth, fifth and sixth control valves 41-1*a*, 41-2*a*, 41-3*a*, 41-4*a*, 41-5*a* and 41-6*a* provided at the first, second and third flexible hoses 40-1, 40-2 and 40-3 are simultaneously opened by the pump ECU 60 or the engine ECU 90, so the oil which is simultaneously sucked by the first, second, third, fourth, fifth and sixth cylinders is discharged from the cylinder block 10. The cylinder explosion sequence suction method is a method wherein the sequence of 1->5->3->6->2->4 which corresponds to the explosion sequence of the first, second, third, fourth, fifth and sixth cylinders 1, 2, 3, 4,5 and 6 is employed, whereby the oil sucked by the first, second, third, fourth, fifth and sixth cylinders 1, 2, 3, 4, 5 and 6 can discharge from the cylinder block 10 in the sequence of "the first control valve 41-1*a* is opened and then closed"->"the fourth control valve 41-4*a* is opened and then closed"->"the fifth control valve 41-5*a* is opened and then closed"->"the second control valve 41-2*a* is opened and then closed"->"the third control valve 41-3*a* is opened and then closed"->"and" the sixth control valve 41-6*a* is opened and then closed. The cylinder identical stroke sequence suction method is a method wherein the oil sucked by the first and sixth cylinders 1 and 6, the second and fifth cylinders 2 and 5, and the third and fourth cylinders 3 and 4 can discharge from the cylinder block 10 in the sequence of "the first and second control valves 41-1*a* and 41-2*a* are opened and then closed"->"the third and fourth control valves 41-3*a* and 41-4*a* are opened and then closed"->"the fifth and sixth control valves 41-5*a* and 41-6*a* are opened and then closed" in such a way to employ 1 and 6, 2 and 5 and 3 and 4 based on the motions at the same top and bottom dead points.

Figure 5:
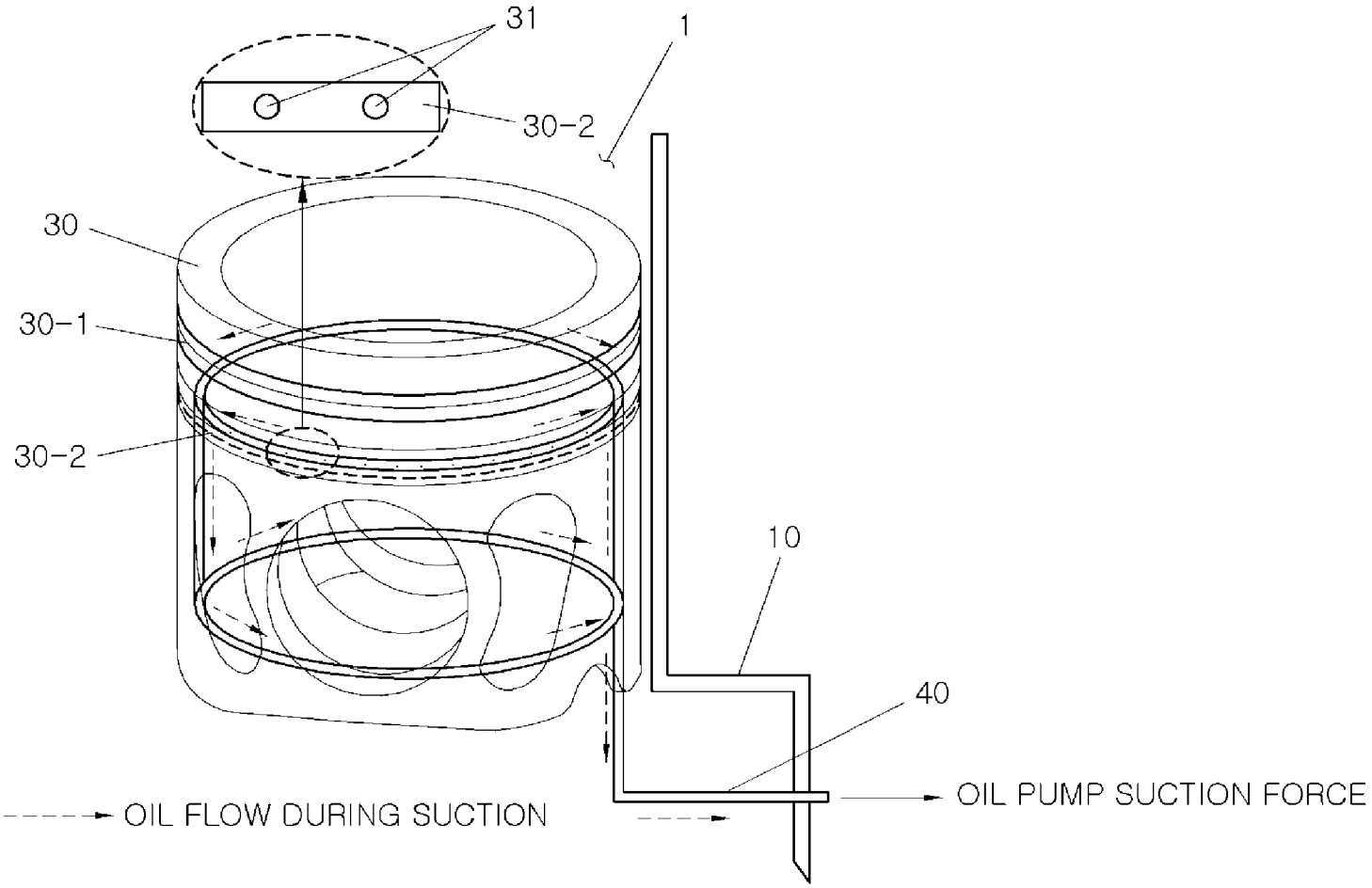
FIG. 5 is a view illustrating a state where a piston suction device of an oil-up oil suction system is operating according to an exemplary embodiment of the present invention.

Referring to FIG. 5, the suction force of the oil pump will be applied to the piston 20 via the oil suction hole 31 of the second piston ring 30-2, and the suction force will allow to suck the oil, which is moving upward above the piston, into the oil suction hole 31, whereby the oil suction line 40 will discharge the sucked oil toward the cylinder block 10.

Meanwhile, in a step S90, the engine ECU 90 will check the pump operation time of the oil pump 50, and the routine will go back to the step S10 after a set pump operation time. In this way, the engine ECU 90 is able to continuously control the oil-up formation condition under the engine operation condition.

According to the piston oil-up prevention of the engine of the present invention, any of the cylinder total control suction method, the cylinder explosion sequence suction method and the cylinder identical stroke sequence suction method is employed in case of the oil-up formation, by which the oil-up oil moving upward above the piston 20 provided at each of the first, second, third, fourth, fifth and sixth cylinders of the cylinder block can be sucked, whereupon the oil-up prevention can be efficiently carried out during the idle operation and the coasting in such a way that the suction of the oil-up oil is carried out using the suction force of the oil pump.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for preventing a piston oil-up, comprising:

determining an oil-up condition formation using a controller, wherein an oil-up condition generates when an engine oil moves upward above a piston, after verifying an engine operation state;

determining a suction condition of the oil-up condition to use the controller based on any of a cylinder total control suction method, a cylinder explosion sequence suction method and a cylinder identical stroke sequence suction method when the oil-up condition has been formed; and operating an oil pump using the controller, sucking an oil-up oil using a suction force of the oil pump and discharging the sucked oil-up oil from a cylinder block.

2. The method of claim 1, wherein the engine operation state is checked based on detection values of an engine RPM (Revolution Per Minute) and an oil pressure.

3. The method of claim 1, wherein the oil-up condition formation is determined based on an engine idle condition and a coasting condition, and the determination on the coasting condition is carried after the engine idle condition is judged.

4. The method of claim 3, wherein the engine idle condition is an oil pressure, and the coasting condition is an intake manifold negative pressure.

5. The method of claim 4, wherein the oil pressure is compared to a check valve opening pressure of an engine oil flow passage of the engine, and when the oil pressure is equal to or larger than the check valve opening pressure, it is determined that an oil-up condition has formed.

6. The method of claim 4, wherein the intake manifold negative pressure is compared to a predetermined value, and when the intake manifold negative pressure is smaller than the predetermined value, it is determined that the oil-up condition has formed.

7. The method of claim 6, wherein the predetermined value is 100 Kpa.

8. The method of claim 1, wherein in the cylinder total control suction method, the oil-up oil is simultaneously sucked by a plurality of cylinders of the engine.

9. The method of claim 1, wherein in the cylinder explosion sequence suction method, the oil-up oil is sucked in an explosion sequence of a plurality of the cylinders of the engine.

10. The method of claim 1, wherein in the cylinder identical stroke sequence suction method, the oil-up oil is sucked based on motions at a same top and bottom dead points of a plurality of the cylinders of the engine.

11. The method of claim 1, wherein the controller controls a pump ECU (Electronic Control Unit), and the pump ECU controls the oil pump.

12. The method of claim 1, wherein the controller is an engine ECU (Electronic Control Unit).

13. An engine, comprising:

a piston provided at each of a plurality of cylinders of a cylinder block, wherein an oil suction hole is formed at a piston ring of the piston; and an oil-up oil suction system including:

a plurality of oil suction lines connected to the piston and extending from the cylinder block; and an oil pump fluidically communicating with the plurality of oil suction lines and driven according to a pump Electronic Control Unit (ECU) when an oil pressure of the engine rises or an intake manifold negative pressure decreases, thus generating a suction force at the oil suction lines, wherein the pump Electronic Control Unit (ECU) is associated with the engine ECU to control the oil pump, wherein the oil-up oil suction system is connected to an oil filter unit which is connected to an outlet of the oil pump via a hose, and the oil filter unit is configured to purify oil discharged to the cylinder block via the oil-up oil suction system and supply the purified oil to an oil pan, and wherein the oil filter unit is connected to a turbo charger, and the turbo charger is provided to flow mist oil containing a blow-by gas outputted from the oil filter unit, into a compressor.

14. The engine of claim 13, wherein the oil-up oil suction system is provided at each of the plurality of the cylinders of the cylinder block, and the oil suction hole is connected to the piston provided at each of the piston rings.

* * * * *